US007032547B2

(12) United States Patent
Xin

(10) Patent No.: US 7,032,547 B2
(45) Date of Patent: Apr. 25, 2006

(54) CYLINDER BLOCK COOLING ARRANGEMENT FOR MULTI-CYLINDER INTERNAL COMBUSTION ENGINE

(75) Inventor: Jun Xin, Powell, OH (US)

(73) Assignee: Honda Motor Co., Ltd., Tokyo (JP)

( * ) Notice: Subject to any disclaimer, the term of this patent is extended or adjusted under 35 U.S.C. 154(b) by 44 days.

(21) Appl. No.: 10/829,695

(22) Filed: Apr. 22, 2004

(65) Prior Publication Data

US 2005/0235930 A1 Oct. 27, 2005

(51) Int. Cl.
*F02F 1/10* (2006.01)

(52) U.S. Cl. ..... 123/41.72

(58) Field of Classification Search ..... 123/41.72, 123/41.74, 41.79
See application file for complete search history.

(56) References Cited

U.S. PATENT DOCUMENTS

| | | | |
|---|---|---|---|
| 4,569,313 | A | 2/1986 | Nobu |
| 5,207,189 | A | 5/1993 | Kawauchi et al. |
| 5,253,615 | A | 10/1993 | Heater et al. |
| 5,542,381 | A | 8/1996 | Noda et al. |
| 5,558,048 | A | 9/1996 | Suzuki et al. |
| 5,746,161 | A | 5/1998 | Boggs |
| 5,988,120 | A | 11/1999 | Betsch et al. |
| 6,138,619 | A | 10/2000 | Etemad |
| 2002/0000210 | A1 | 1/2002 | Shinpo et al. |

FOREIGN PATENT DOCUMENTS

| | | |
|---|---|---|
| JP | 04136461 | 5/1992 |

*Primary Examiner*—Tony M. Argenbright
*Assistant Examiner*—Katrina B. Harris
(74) *Attorney, Agent, or Firm*—Rankin, Hill, Porter & Clark LLP

(57) ABSTRACT

An insert for a siamese-type internal combustion engine that separates a water jacket surrounding the cylinders into an upper portion and a lower portion. Below a predetermined engine speed coolant flows primarily in the upper water jacket portion so as to provide enhanced cooling at the upper portions of the cylinders. Above a predetermined engine speed coolant is introduced into the lower water jacket portion from the upper water jacket portion so as to provide improved cooling of the lower cylinder portions, without compromising cooling of the upper cylinder portions or the conjoined cylinder wall portions. The water jacket insert enhances coolant flow velocity at the siamesed or conjoined portions of the cylinder walls, and directs incoming initially coolant over the exhaust-side of the cylinders. Use of the insert reduces circumferential and axial intra-cylinder temperature deviations as well as inter-cylinder temperature deviations.

27 Claims, 5 Drawing Sheets

CYLINDER BLOCK COOLING ARRANGEMENT FOR MULTI-CYLINDER INTERNAL COMBUSTION ENGINE

BACKGROUND OF THE INVENTION

1. Field of the Invention

The present invention generally relates to internal combustion engines and, more particularly, toward cooling flow structures and methods in a cylinder block of multi-cylinder internal combustion engines.

2. Description of Related Art

Siamese-type engine blocks minimize the length and weight of the engine by eliminating the space between adjacent cylinders and, as such, include cylinders having conjoined walls. Multi-cylinder siamese-type internal combustion engines are typically cooled by circulating coolant through a water jacket formed between the cylinder walls and the engine block.

A conventional engine block cooling arrangement is schematically illustrated in FIG. 14, wherein the siamese-type cylinder walls 110, the water jacket 111 and the head 112 are schematically illustrated. In this arrangement, coolant is introduced into the water jacket 111 via an inlet 114, and flows around both sides of the cylinders 110. A head gasket 113 is disposed between the upper surface of the engine block and the head 112, and coolant flows upwardly through holes 116 formed in the head gasket 113 into the head 112. It is noted that a major portion of the gasket holes 116 are formed in an end of the head gasket 113 opposite the coolant inlet 114. As such, a relatively major portion of coolant flows from the inlet end of the water jacket 111 to the opposite end of the water jacket and through the major portion of the gasket holes 116, and a relatively minor portion of the coolant flow goes through the head 112, perhaps only 30% of the total flow.

Unfortunately, due to the structure of such cylinder blocks and the flow of combustion gases, temperature differences exist between different sides of the cylinders (i.e., intake v. exhaust), different ends of the cylinders (top v. bottom) and between different cylinders (i.e., end cylinders v. internal cylinders). These temperature differences are not addressed in the aforementioned conventional cooling arrangement, and create problems in maintaining generally consistent cylinder temperatures.

For example, the heat path to coolant flow from the siamese regions (i.e., conjoined regions of adjacent cylinders) is longer than the heat path to coolant flow from other areas, and inevitably results in non-uniform temperature distribution on the combustion chamber surface. This, in turn, causes thermal expansion differences between inner, conjoined portions of the cylinder walls, which lack direct contact with a cooling water passage, and external portions of the cylinder walls, which are in direct contact with a cooling water passage. Thus, it is desirable to improve the cooling efficiency at the conjoined portions as compared to the non-conjoined regions so as to reduce this temperature difference.

Also, along the circumference of a cylinder, the exhaust-side cylinder wall surface is hotter than the intake-side cylinder wall surface. Thus, it is desirable to improve the exhaust-side cylinder wall cooling efficiency relative to the intake-side cylinder wall cooling efficiency so as to reduce a temperature difference or gradient between the exhaust side of the cylinder and the intake side of the cylinder.

Further, the cylinder walls, when viewed in an axial direction, also require different cooling capabilities because the upper portion of the cylinder is exposed to hotter combustion gas than the lower portions of the cylinder, and, furthermore, because the upper portion surface is exposed to combustion gas longer than the lower portion. Accordingly, it is desirable to improve cooling efficiency at the cylinder upper portions as compared to the cylinder lower portions so as to reduce these temperature differences.

When viewed in total, it is generally desirable to have higher cooling capacities on the exhaust side and upper end of the cylinders as compared to the intake side and lower end of the cylinders.

Temperature differences in the cylinder wall may result in engine operational problems. For example, if the cylinder wall is distorted due to differing amounts of thermal expansion, the piston ring at the upper side of the piston, which reciprocates vertically within the cylinder, does not uniformly seal to the cylinder wall but rather will partially stick to the cylinder wall at some locations and loosely slide over the cylinder wall at other locations. Temperature uniformity along the cylinder axis improves clearance or clearance tolerance between the piston and cylinder wall surface as the piston reciprocates within the cylinder bore, and therefore reduces friction and improves sealing throughout the piston stroke. Accordingly, a uniform temperature in the circumferential and axial directions is desired so as to permit uniform sealing engagement between the piston ring and the cylinder wall, while having minimal frictional resistance during reciprocating movement of the piston. Moreover, it is desirable to arrange the cooling flow in multi-cylinder engines such that temperature distribution on each cylinder wall is as close as possible to reduce cylinder-to-cylinder variation of power output.

In addition to the problems associated with thermal deformation, an auto-ignition tendency in spark ignition engines is related to combustion chamber surface temperature. Reducing hot spot temperature (i.e., localized areas of increased temperature) reduces the chances for auto-ignition, and has a positive impact on engine performance and fuel economy.

It is also known that the sooner an engine reaches ideal operating temperature conditions, the more efficiently it operates. Therefore, it is desirable to reduce the heat removal rate on the lower portion of the cylinder walls to accelerate warming-up of engine oil through crankcase walls, to accelerate warming-up of the cylinder walls, and to improve engine fuel economy by reducing heat loss.

Much work has been done in the past in response to these needs. For example, U.S. Pat. No. 5,558,048 discloses an engine cooling system that reduces cylinder wall deformation. For an engine having a plurality of cylinders that are arranged along a longitudinal axis of the engine, an intermediate wall is provided between every two adjacent bores. The '048 patent teaches forming a cutout in the siamese areas to improve cooling.

U.S. Pat. No. 5,542,381 attempts to improve cooling flow rate and heat transmission in the Siamese areas by including flow guide ribs in a central position inside the passage with respect to the vertical width of the passage. However, the '381 patent discloses improving cooling in the hollow areas, while it is known that the upper regions of the cylinder are under much higher thermal loading than the lower regions of the cylinder. Furthermore, efficient installation of such guide ribs during mass production presents a major obstacle.

Thomas Heater et al. (U.S. Pat. No. 5,253,615) proposes to shorten engine warm-up with shallow water jackets surrounding its cylinders. In order to maintain uniform wall thickness and prevent combustion noise from emitting directly to the outside, an isolation chamber is formed in the area between the shallow water jacket and the top of the crankcase cavity. However, this design significantly complicates high-pressure aluminum die casting, which is widely used to manufacture cylinder blocks.

Tokkai Hei 4-136461 published by the Japanese Patent Office in 1992 proposes decreasing the width of the water jacket midway along its height so as to increase the flow velocity of cooling liquid through the siamese areas.

Masato Kawauchi et al. (U.S. Pat. No. 5,207,189) attempts to eliminate coolant flow stagnation by forming a plurality of annular passages between a cylinder block and the cylinder liner fitted in the cylinder block, especially for wet-liner engine block.

Jocken Betsch et al. (U.S. Pat. No. 5,988,120) utilizes a displacement body in the coolant space to reduce effective coolant space volume. Therefore, an intensive cooling is achieved with a reduced coolant quantity for the entire bore surface.

Habuo Nobu (U.S. Pat. No. 4,569,313) attempts to improve cooling uniformity of engine cylinder head and block by implementing block partition walls between cylinders.

David Boggs (U.S. Pat. No. 5,746,161) proposes a tapered water jacket along the cylinder axis to improve the uniformity of cylinder wall temperature. Unfortunately, the passage thickness at the bottom is limited by the manufacturability, or imposes significant cost increases, and therefore the Boggs structure has proven to be commercially or functionally impractical.

Sassan Etemad (U.S. Pat. No. 6,138,619) suggests a flow directing device protruding from a support element above the top surface of a block to improve cooling. However, the proposed method is expensive and has a negative impact on combustion gas sealing. Furthermore, it does not affect temperature uniformity and shortening of engine warm-up.

Yoshikazu Shinpo and Takashi Matsutani (US Patent Application Publication No. 2002/0000210) attempt to achieve uniform cylinder wall temperature by disposing a spacer in the water jacket. The ideas as described in embodiments 1 to 10 will increase cylinder wall temperature of lower portion, which will adversely affect piston heat dissipation capability and engine performance due to charge heating. Embodiments 45 to 48 address high cylinder wall temperature problems at high engine speed, but require devices to adjust flow rate, which increases the cost and requires a new engine block design and a new coolant flow layout.

Accordingly, while various attempts have been made to address one or more of these competing concerns, there remains a need in the art for a method and device that reduces temperature variation within each cylinder and between adjacent cylinders in a multi-cylinder siamese-type internal combustion engine.

SUMMARY OF THE INVENTION

The present invention is directed toward a method and device whereby a temperature at the uppermost portion of a cylinder wall is reduced, and the uniformity of a temperature profile in the circumferential direction is improved. The present invention is further directed toward a method and device wherein heat removal from a lower portion of a cylinder wall is reduced so as to shorten the time for engine component and lubricant warm up. Further, with the method and device of the present invention, circumferential and axial temperature deviation in individual cylinders of a siamese-type multi-cylinder internal combustion engine (i.e., intra-cylinder temperature deviation) is reduced, and wherein temperature variation between each of the cylinders (i.e., inter-cylinder temperature deviation) is reduced.

The present invention is further directed toward a simple and effective method of distributing coolant flow according to engine operating conditions. With the present invention, thermal distortion of the engine block and/or cylinder walls is reduced or minimized, cylinder block durability is improved, and engine knock toughness is also improved.

In accordance with the present invention, an engine includes an engine block containing a plurality of cylinders and a cylinder head disposed on the engine block. The cylinder block includes first and second ends, a first or exhaust side, a second or intake side, cylinder walls, and a lower wall that cooperate with a head to define a water jacket. Such an engine block structure is known in the art and is sometimes referred to as an open deck siamese-type block structure.

In accordance with the present invention, an insert is separately manufactured and disposed in the engine block water jacket. The insert includes a plurality of arcuate members and a plurality of support members, which are preferably integrally formed as a single part. The insert is disposed in the water jacket so as to separate the water jacket into two or more vertically or axially offset sub-jackets or portions. The insert separates the water jacket into a plurality of cooling layers in the direction of the cylinder axis, and thereby provides a desired coolant flow pattern. At least some of the support members are disposed adjacent inter-bore or conjoined portions that require additional cooling, and serve to guide coolant flow toward these siamesed or conjoined wall portions.

In further accordance with the present invention, the arcuate members have holes or notches formed therein to permit fluid in vertically adjacent, but otherwise separate, portions of the water jacket to flow therethrough. The holes facilitate filling and draining of the water jacket with reduced entrapment of air or fluid, and permit engine speed-dependent coolant flow distribution among layers of the water jacket volume. More particularly, the holes are arranged so that coolant flows in an upper portion of the water jacket when engine speed is below a pre-defined engine speed and, as engine speed increases, an increasing amount of coolant flows into the water jacket lower portion through the holes, and re-emerges to the water jacket upper portion via further holes at desired downstream locations. Accordingly, the insert of the present invention allows the cooling characteristics to respond to operational requirements of the engine.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
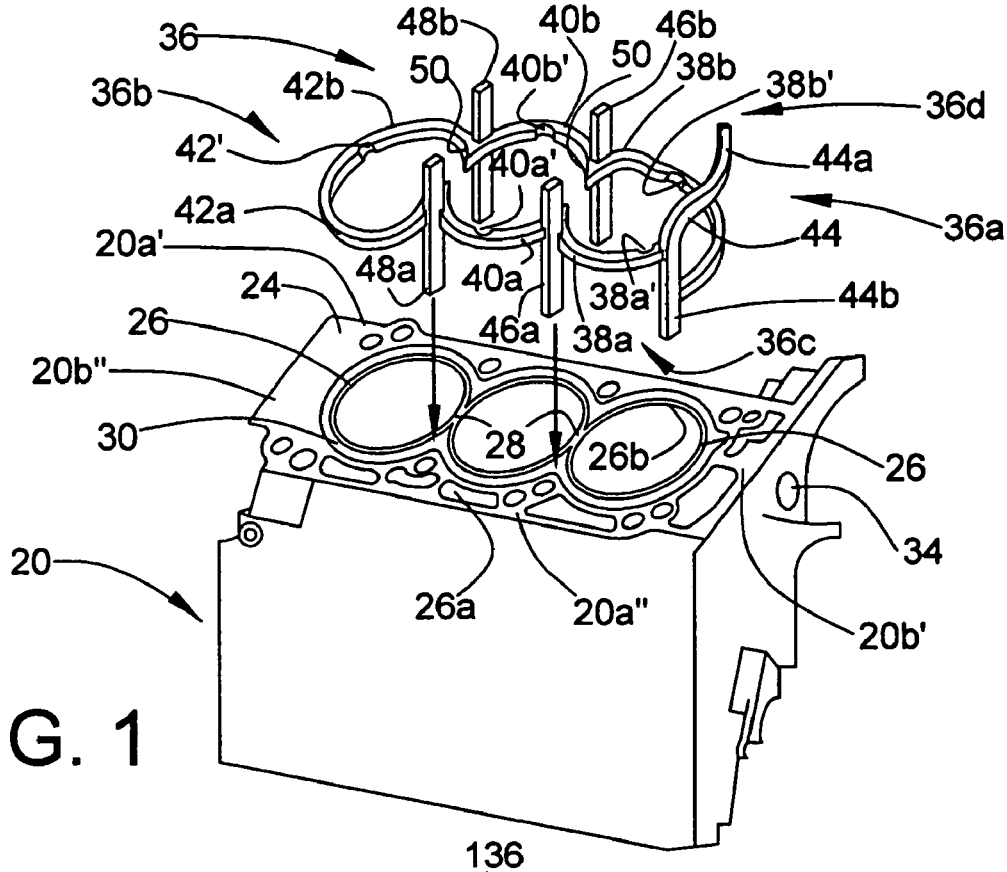
FIG. 1 is a schematic exploded perspective view of a portion of an engine block and an insert according to the present invention.

With reference to FIG. 1, a portion of a siamesed-type internal combustion engine block 20 is illustrated with the associated head 22 (see FIG. 2) removed from a top deck surface 24 of the block 20. As shown in FIG. 1, the engine block 20 includes a series of cylinders 26 that are arranged next to one another, with walls of adjacent cylinders being united to defined conjoined portions 28. The cylinders 26 are open at their upper and lower ends, with the upper end being normally covered by the cylinder head 22, in which required intake and exhaust valves (not shown) are disposed. Each cylinder wall 26 cooperates with the head 22 and a piston (not shown) to define a combustion chamber.

Hereinafter the circumferentially opposite sides of the cylinders will be referred to as an "intake-side" 26*a* and an "exhaust-side" 26*b*, respectively. The terms "cylinder" and "cylinder walls" will be used interchangeably hereinafter and can be considered to be the cylindrical structure defining the lateral extent of the combustion chambers. The siamesed or conjoined cylinder wall portions 28 are ordinarily located circumferentially between the cylinder intake side 26*a* and the cylinder exhaust side 26*b*.

A coolant flow passage or water jacket 30 is formed in the engine block 20 and around the cylinders 26. The water jacket 30 is bounded by the outer surface of the cylinder walls 26, the engine block sidewalls 20*a*', 20*a*", end walls 20*b*', 20*b*", and bottom wall 20*c* (FIG. 4), and the head 22. A coolant inlet 34 to the water jacket 30 is provided in the first end 20*b*' of the cylinder block 20*b* and a coolant outlet 22*a* is provided in the head 22 at the second or opposite end 20*b*" of the engine block 20.

The engine block structure as described to this point is relatively conventional and forms no part of the present invention. Rather, the present invention provides a structure whereby the cooling characteristics and, more specifically, the coolant flow path and cooling properties of the water jacket, may be simply modified without affecting the basic engine block structure or operation of the engine.

Figure 2:
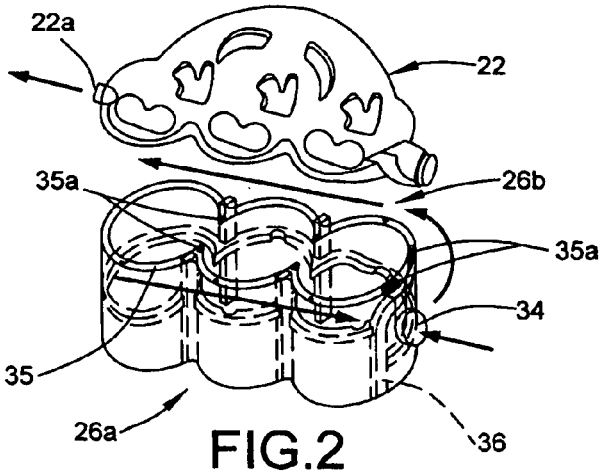
FIG. 2 schematically illustrates the cylinders and the water jacket, with a head disposed over the cylinders, and illustrates coolant flow through the water jacket when the insert according to the present invention is inserted therein.

With reference to FIG. 2, a gasket 35 is disposed between the cylinder block top deck surface 24 and the head 22, and has holes 35*a* formed therein through which coolant from the water jacket 30 enters the head 22. The holes 35*a* are provided at predetermined locations, such as adjacent the conjoined portions 28 to encourage coolant flow at these locations. However, in the present invention, a major portion of the gasket holes 35*a* (i.e., the largest holes and the greatest concentration of holes and, thus, the greatest flow into the head 22) are provided near the first end 20*b*' of the cylinder block 20 such that coolant flows into the head 22 primarily at the first end 20*b*' of the cylinder block 20 and then flows through passageways in the head 22 to the outlet 22*a* at the second end 20*b*" of the engine block 20, as will be apparent from the following description.

FIG. 1 shows a water jacket insert 36 according to the present invention disposed above the engine block 20 prior to placement therein. FIG. 2 shows the same insert 36, albeit in phantom, disposed around the cylinders 26. FIGS. 3–7 provided more detailed views of the insert 36 and the placement of the insert within the water jacket 30.

The insert 36 includes a plurality of curved or arcuate members 38*a*, 38*b*; 40*a*, 40*b*; 42*a*, 42*b* and a plurality of support members 44; 46*a*, 46*b*; 48*a*, 48*b*. In the embodiment illustrated in FIG. 1, two arcuate members are provided for each cylinder, with one arcuate member 38*a*, 40*a*, 42*a* being disposed on the intake side 26*a* of each cylinder 26 and the other arcuate member 38*b*, 40*b*, 42*b* being disposed on the exhaust side 26*b* of each cylinder 26. The support members 44, 46*a*, 46*b*; 48*a*, 48*b* serve as structural supports for the arcuate members, as spacers or positioning aids that insure proper vertical positioning of the insert 36 within the water jacket 30, and as flow directors to encourage coolant flow toward conjoined portions 28 of the cylinder walls 26, as will be described more fully hereinafter.

Although the insert 36 illustrated in FIG. 1 is specifically designed for use in the illustrated water jacket 30 that surrounds three cylinders 26, it is contemplated that the insert would be useful and easily adapted for use in water jackets associated with more or less than three cylinders.

The insert 36 includes opposed first and second ends 36*a*, 36*b*, a first or intake side 36*c*, and a second or exhaust side 36*d*. The insert first end 36*a*, which is received in the water jacket 30 at the first end 20*b*' of the engine block 20, includes a first support member 44 that is elongated vertically and laterally so as to surround one side of the coolant inlet 32.

The first support member 44 separates incoming coolant flow from outgoing coolant flow, and forces the incoming coolant to flow toward the exhaust side 26*b* of the cylinders 26. Generally, and as will be described more fully hereinafter, the incoming coolant flows from the engine block first end 20*b*', along the exhaust side 26*b* of the cylinders 26*b* to the engine block second end 20*b*", and then back along the intake side 26*a* of the cylinders 26 to the engine block first end 20*b*'. When returned to the first end 20*b*' of the engine block 20, the coolant flows through the gasket holes 35*a* into the head 22 and then through the head passageways to the outlet 22*a* at the engine block second end 20*b*". Since the coolant temperature increases as it flows through the water jacket 30, directing incoming fluid to the exhaust side of the cylinders 26 enhances cooling of the exhaust side 26*b* as compared to the intake side 26*a* and helps to alleviate circumferential temperature deviation within the cylinders.

The first support member 44 includes a generally linear portion 44*b* that extends downwardly from the intersection with the first intake-side arcuate member 38*a* and a curved upper portion 44*a* that extends across the top of the coolant inlet 34, reaches circumferentially around the cylinder wall 26 toward the exhaust side 26*b* of the cylinder, and then upwardly so as to terminate at the top of the water jacket 30. As such, and with reference to FIG. 2, the first support member 44 isolates the large gasket holes 35*a*, through which coolant flows into the head 22, from the incoming coolant flow. To that end, the first support member 44 has a width that is equal to the width of the water jacket 30 at the location in which the first support member is disposed, so as to define the desired coolant flow direction.

A first intake-side arcuate member 38*a* and a first exhaust-side arcuate member 38*b* are provided at the insert first end 36*a*. The first support member 44 is disposed generally at the union of the first arcuate members 38*a*, 38*b* and extends upwardly and downwardly therefrom. It is noted that in the illustrated embodiment the first exhaust-side arcuate member 38*b* connects to the first support 44 at a vertical or axial position that is relatively lower than that of the first intake-side arcuate member 38*a*. Although this arrangement is preferred in the illustrated embodiment, it is not mandatory, with it being realized that in other embodiments the exhaust-side arcuate members are preferably disposed vertically above their corresponding intake-side arcuate members. In this regard it should be realized that, to some extent, placement of the first arcuate members is dependent upon the location of the coolant inlet 34.

Support members are disposed at the union or intersection of adjacent arcuate members on each side 36*c*, 36*d* of the insert 36, as illustrated. More specifically, a second support member 46*b* is disposed at the union of the first and second exhaust-side arcuate members 38*b*, 40*b* and a third support member 48*b* is disposed at the union of the second and third exhaust-side arcuate members 40*b*, 42*b*. Similarly, a fourth support member 46*a* is disposed at the union of the first and second intake-side arcuate members 38*a*, 40*a* and a fifth support member 48*a* is disposed at the union of the second and third intake-side arcuate members 40*a*, 42*a*.

The third exhaust-side arcuate member 42*b* and the third intake-side arcuate member 42*a* are integrally formed so as to define a member having a C-shaped profile when viewed from above which, preferably, is unsupported vertically, as illustrated. Naturally, a further support member may be added, preferably at the imaginary intersection of the third exhaust-side arcuate member 42*b* and the third intake-side arcuate member 42*a*, if further vertical support is desired.

The arcuate members 38*a*, 38*b*; 40*a*, 40*b*; 42*a*, 42*b* have a varying width dimension that is selected so as to fill or extend across the width of the water jacket 30 (i.e., extend from the outside surface of the cylinder wall 26 to the corresponding inside surface of the cylinder block 20) in a direction generally normal to the cylinder axis.

Figure 3:
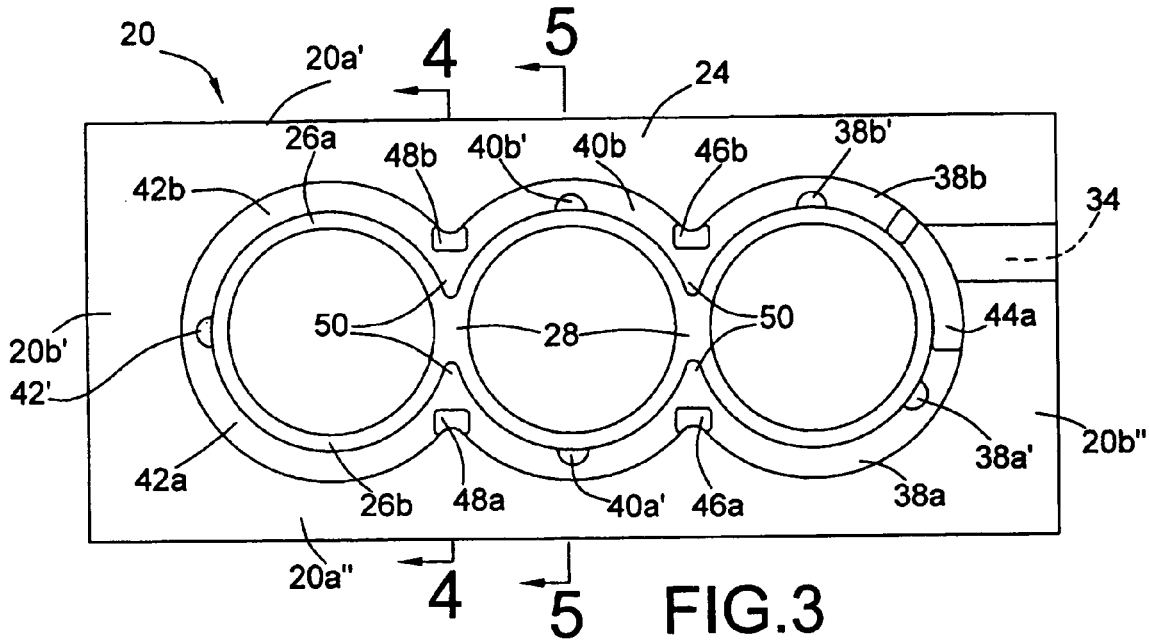
FIG. 3 is a top plan view of the insert disposed within the engine block.
Figure 4:
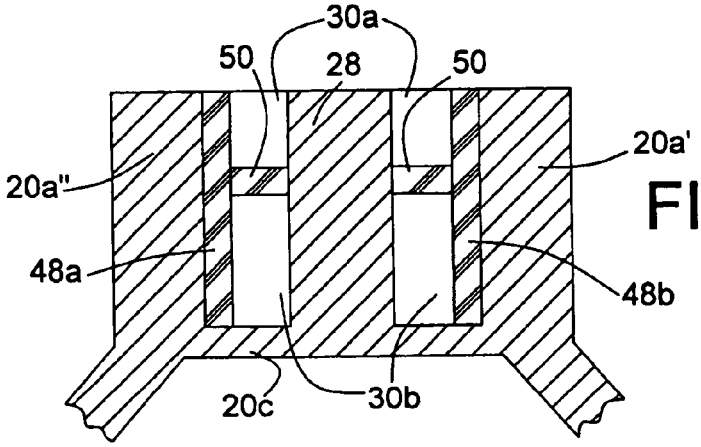
FIG. 4 is a cross-sectional view of the insert as seen along lines 4—4 of FIG. 3.
Figure 5:
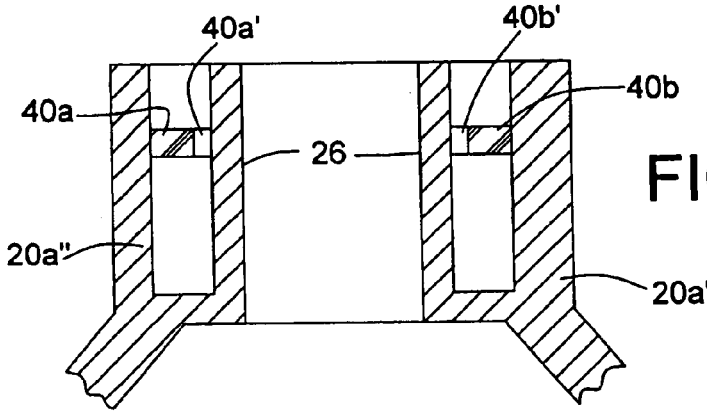
FIG. 5 is a cross-sectional view of the insert as seen along lines 5—5 of FIG. 3.

With reference to FIGS. 3 and 4, adjacent the second through fifth supports 46*b*, 48*b*, 46*a*, 48*a*, the insert 36 and, more specifically, the insert arcuate members 38*a*–42*b*, include inwardly projecting ear portions or extensions 50. The ear portions 50 extend toward the conjoined portions 28 of the cylinders 26 and fill a wedge-shaped gap that would otherwise exist between the cylinders 26. Accordingly, when the insert 36 is installed in the water jacket 30, the insert arcuate portions 38*a*–42*b* and ear portions 50 essentially occupy the width of the water jacket and thereby divide the water jacket 30 into a first or upper portion 30*a*, which receives incoming coolant, and a second or lower portion 30*b*, which has a reduced flow therethrough. Since the upper portions of the cylinders are hotter than lower portions of the cylinders, increasing coolant flow over the upper cylinder portions as compared to the lower cylinder portions helps to reduce axial temperature variation within the cylinders.

The presence of the supports 46*a*–48*b* laterally adjacent the conjoined portions 28 and extending along the length of the conjoined portions 28, creates restrictions that increase coolant flow velocity toward and past the conjoined portions 28, as will be described hereinafter. More specifically, and with reference to FIG. 4, the second to fifth supports 46*b*, 48*b*, 46*a*, 48*a*, which are disposed within the water jacket 30 adjacent the inner surface of the cylinder block 20 (i.e., spaced from the cylinder walls 26), have a length that is generally equal to a height of the water jacket 30, and a width that is substantially less than the water jacket width. The second to fifth support members 46*b*, 48*b*, 46*a*, 48*a* preferably have a width that is between about 30–70% of the associated water jacket width, and more preferably about 50% of the water jacket width. The exact size of the support members will, or course, be tuned to providing the desired cooling affect at the conjoined portions 28.

As such, the second to fifth support members occupy an area in the water jacket aligned with the conjoined cylinder wall portions 28 but spaced therefrom, and serve to reduce the water jacket's effective width at these critical areas and direct coolant fluid, at higher speed, toward the conjoined cylinder wall portions 28. Although the support members are illustrated as having a leading surface to flow that is generally perpendicular to the flow direction, it is contemplate that the leading surface could be angled or profiled so as to encourage flow toward the conjoined portions 28. Enhancing coolant flow and coolant flow velocity at the conjoined portions of the cylinders, as compared to other portions of the cylinders, increases cooling at the conjoined portions and thereby reduce or eliminate temperature deviation between the conjoined portions and the remainder of the cylinder.

In the preferred embodiment illustrated in FIG. 1, each of the first and second arcuate members 38*a*, 38*b*; 40*a*, 40*b* has a hole 38*a*', 38*b*'; 40*a*', 40*b*' formed there that permits fluid to flow therethrough so as to communicate coolant between the water jacket upper portion 30*a* and the water jacket lower portion 30*b*. Similarly, a hole 42' is provided near the union of the third intake and exhaust side arcuate members 42*a*, 42*b* to permit fluid to pass between the upper and lower water jacket portions 30*a*, 30*b*. Preferably, the holes 38*a*', 38*b*'; 40*a*', 40*b*'; 42' are formed as notches in the first, second, and third arcuate members such that, when installed in the water jacket 30, the notches face the associated cylinder wall 26 and cooperate therewith to define a passageway.

The notch 38*a*' in the first intake-side arcuate member is disposed relatively close to the first support member 44, while the notches 40*a*', 40*b*' in the second arcuate members 40*a*, 40*b* and the notch 38*b*' first exhaust-side arcuate member 38*b* are preferably disposed generally at the midpoint along their length, as illustrated. The notch 42' is positioned, as described hereinbefore, at the union of the third intake-side and third exhaust-side arcuate members 42*a*, 42*b*, as illustrated. Naturally, the exact position and size of the holes will be tuned to providing desirable engine-speed dependent flow therethrough.

The notches 38*a*', 38*b*'; 40*a*', 40*b*'; 42' are arranged so that the water jacket lower portion 30*b* is completely and quickly filled with coolant fluid without trapping air in the water jacket lower portion 30*b*, so that any vapor produced while operating the engine will flow out of the water jacket 30, and so that the water jacket 30 can be drained of coolant without retaining significant quantities of fluid in the water jacket upper portion 30*a*. Moreover, the holes or notches permit fluid communication between the water jacket upper and lower portions 30*a*, 30*b* that will vary depending upon engine operating conditions, as described more fully hereinafter.

In addition to separating the water jacket 30 into upper and lower portions 30*a*, 30*b*, the insert 36 divides the engine cylinder walls 26 into a plurality of surfaces whose heat transfer coefficient is determined by coolant flow characteristics. These surfaces may be described as the upper/lower exhaust-side surface, the upper/lower intake-side surface, the upper/lower conjoined surfaces (inlet/exhaust), etc.

The present invention takes advantage of the fact that it is possible to improve cooling effectiveness and uniformity by optimizing local coolant velocity. Local coolant velocity is function of $Q_{local}/S_{local}$, where $Q_{local}$ is local coolant volume flow rate, and $S_{local}$ is the local area normal to flow direction. With regard to temperature at the conjoined regions in the upper portion of the water jacket, $S_{local}$ is determined by h (the distance between the insert and the top of the water jacket) and d (the distance between the insert support member and the conjoined portion). $Q_{local}$ is determined by water pump capacity, the openings or notches 38*a*', 38*b*', 40*a*', 40*b*' in the insert 30 that determine coolant divergence into the lower portion 30*b* of the water jacket 30, and the openings 35*a* in the head gasket 35 that determine coolant flow into the cylinder head 22.

The relationship of h and d at different conjoined portions 28 depends on various factors, such as the pressure drop through the water jacket, gasket hole pattern and size, temperature variation at the conjoined portions, etc. In the illustrated embodiment, coolant flow rate gradually decrease as coolant runs through the water jacket 30 because coolant diverges into the head 22. In order to have similar coolant velocities at the different conjoined portions under normal circumstances, and keeping in mind that $Q_{local}$ is higher at an upstream location (e.g., at the conjoined portion corresponding to the second support member 46*b* than at the third support member 48*b*), (h*d) is preferably greater at the upstream location as compared to the downstream location.

As a result, by changing the relative sizes of the support members and the relative vertical position of the arcuate members, different cooling efficiencies at different conjoined portions 28 can be provided so as to provide generally consistent temperatures. Moreover, using this realization it is possible to affect cooling effectiveness by altering either factor h or d, so that a preferred cooling effect is provided at the particular conjoined portion. It is considered apparent that, due to these operational facts, the insert dimensions (i.e., the distance the arcuate members are from the top of the water jacket, the width of the support members, the size and location of the holes in the arcuate members) as well as the gasket properties (the size and location of the gasket holes), will be tuned to the particular host engine, and may also be modified to conform with different anticipated operating environments (i.e., hot climate v. cold climate).

As described above, coolant volume flow rate decreases as coolant flows through the water jacket, the pressure loss due to the presence of the insert is different across each cylinder even if the insert portion for each cylinder is identical. If the reduction of pressure head drop in the water jacket is desired, it is generally more effective to make the upstream portions of the insert more streamlined as compared to the insert downstream portions.

Speed-dependent cooling of the cylinders 26 and, more specifically, the upper and lower portions of the cylinders, respectively, can also be achieved with the present invention. For an engine with the water pump pulley directly driven by the engine's crankshaft, high engine speeds will result in higher flow rate (higher pressure and velocity). The water jacket insert 30, the position and size of the notches formed therein, as well as engine speed dependent flow rates and pressures determine local coolant flow characteristics on these cylinder surfaces. For engine speed-dependent cooling, the notches are sized and arranged so that almost all coolant flows in the upper portion 30*a* of the water jacket 30 when the engine speed is below pre-defined engine speed, and such that an increasing amount of coolant flows into the lower portion of water jacket through the holes, and re-emerge to the water jacket upper portion at desired downstream locations, as engine speed increases above the pre-defined engine speed.

Figure 6:
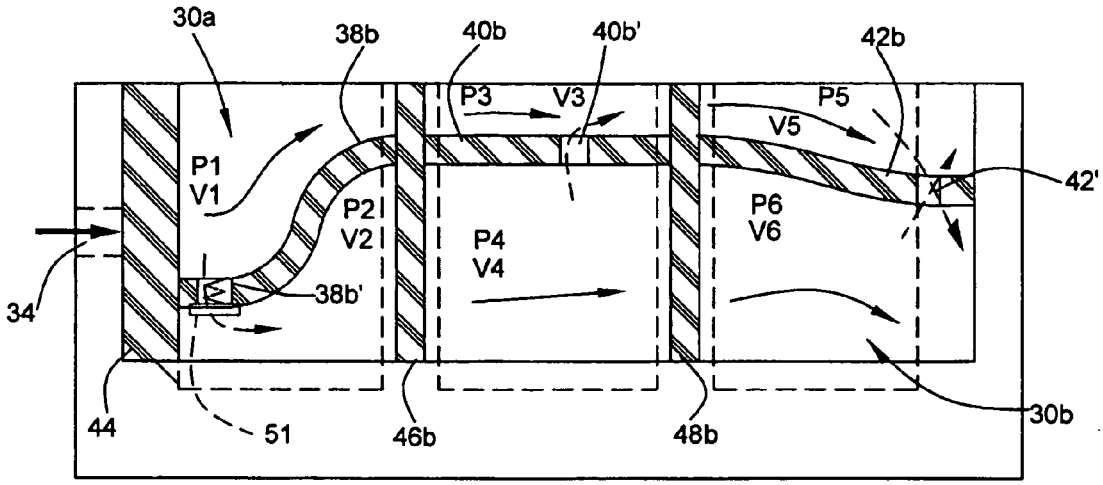
FIG. 6 is a cross-sectional view through the insert on the exhaust side of the engine block and illustrates coolant flow therethrough.
Figure 7:
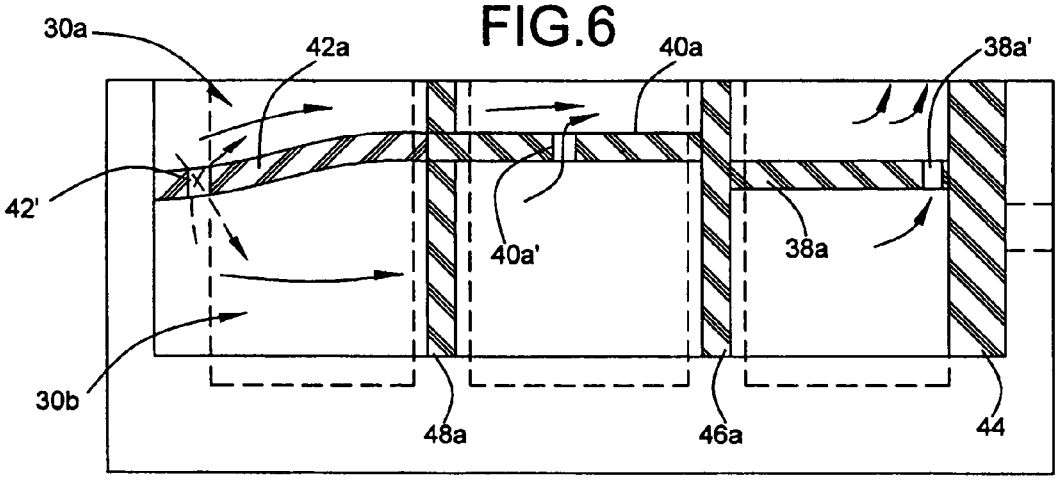
FIG. 7 is a cross-sectional view through the insert on the intake side of the engine block, and illustrates coolant flow therethrough.

Such engine speed dependent coolant flow is based on the Bernoulli relationship between fluid velocity and pressure. With reference to FIG. 6, wherein the exhaust side of the water jacket 30 and insert 36 is illustrated, the coolant volume flow rate through an opening is proportional to S and ΔP, where S is the area of the opening, and ΔP is the pressure difference across the opening. Assuming that pressure in an upper portion of the water jacket is P1, P3, P5 and pressure in a corresponding lower portion of the water jacket is P2, P4, P6 respectively, below a predetermined engine speed, the shape of the insert 36 along with the water jacket and the head gasket hole pattern will essentially determine the pressure distribution. Further, below the predetermined engine speed, coolant flow rate (V1, V3, V5) is not high enough to result in significant static pressure drop in the narrow passage regions in the uppermost portion of water jacket. The water jacket and insert are preferably sized and matched such that V3>V5>V1 because most cooling is required at the inner or middle cylinder, and relatively more cooling is required at the end cylinder than at the inlet-side cylinder, as discussed previously. Therefore, there is no significant pressure difference between the water jacket upper and lower portions 30*a*, 30*b* across the holes 38*b*', 40*b*', 42' in the arcuate members and coolant flow is very small in the water jacket lower portion 30*b*.

However, when engine speed is above a predetermined speed, coolant pressure and flow rate (i.e., V1, V3) in the water jacket upper portion 30*a* are high. At this point, the pressure in the upper portion (P1) is sufficiently greater than the pressure in the lower portion (P2) to cause coolant to flow through the notch 38*b*' from the upper portion 30*a* of the water jacket 30 into the lower portion 30*b*. This situation is illustrated by the dashed line arrow in FIG. 6. The coolant flow rate (i.e., V2, V4) within the water jacket lower portion 30*b* increases, but will still be smaller than that within the upper portion 30*a* (i.e., V1, V3). As coolant exits the upper portion 30*a* (i.e., via gasket holes 35*a* into the head 22), the upper portion downstream pressure decreases (i.e., P4>P3) and coolant flows through the notches from the lower portion 30*b* to the upper portion 30*a* of the water jacket. As a result, rate of removal of thermal energy in the lower portion of the cylinder walls is increased when engine speed is high, while cooling of inter-bore or conjoined portions of the cylinder wall upper portions is not compromised.

Similarly, coolant will flow between the upper and lower water jacket portions 30*a*, 30*b* through the notch 42' formed at the intersection or union of the third intake-side arcuate portion 42*a* and the third exhaust-side arcuate portion 42*b*. Naturally, the direction and rate of flow will be rather dynamic, and will depend upon the operating characteristics of the engine, the flow rate and pressure at that portion of the engine. Accordingly, at some times there will be little if any flow in this region, while at other times flow through the notch 42' may be significant. It is contemplated that in some installations this notch 42' may be omitted.

Figure 11:
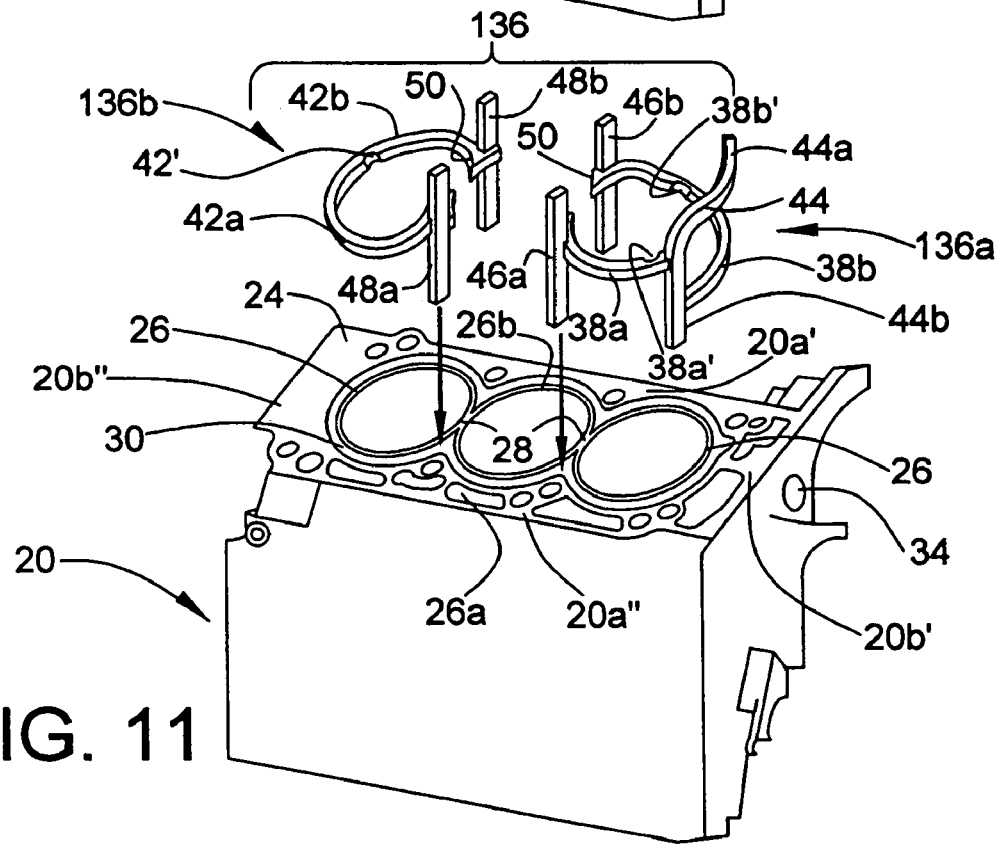
FIG. 11 is an exploded perspective view of a further alternative embodiment of the present invention.
Figure 12:
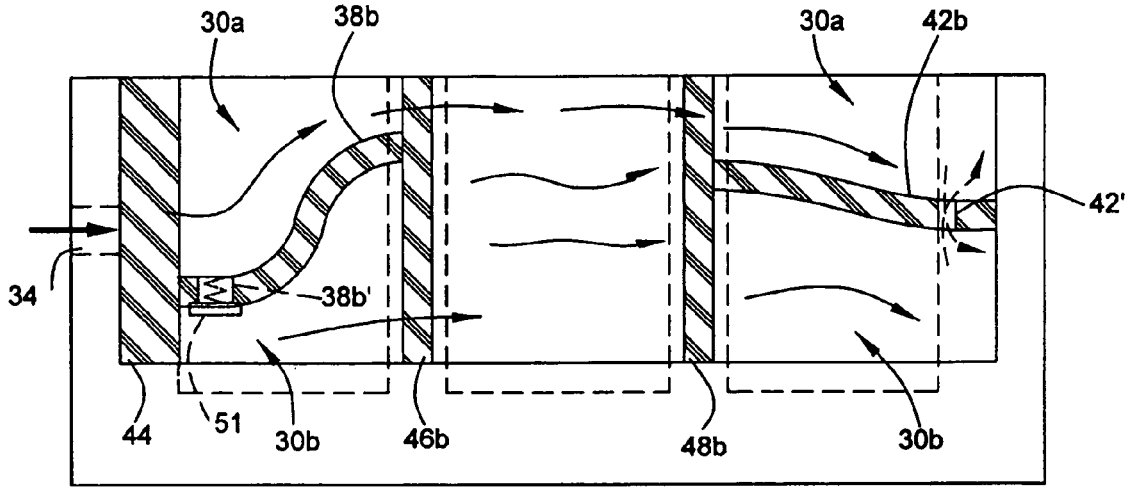
FIG. 12 is a cross-sectional view through the insert of FIG. 11 on the exhaust side of the engine block and schematically illustrates coolant flow through the water jacket.
Figure 13:
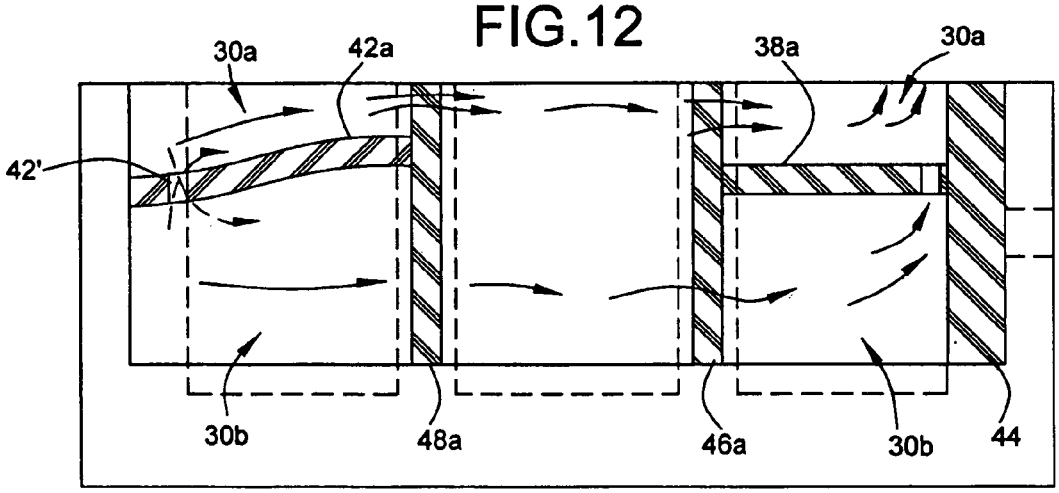
FIG. 13 is a cross-sectional view through the insert of FIG. 11 on the intake side of the engine block and schematically illustrates coolant flow through the water jacket; and, FIG. 14 is a schematic perspective view of the cylinders and water jacket, with the head disposed thereover, illustrating a conventional coolant flow arrangement.
Figure 14:
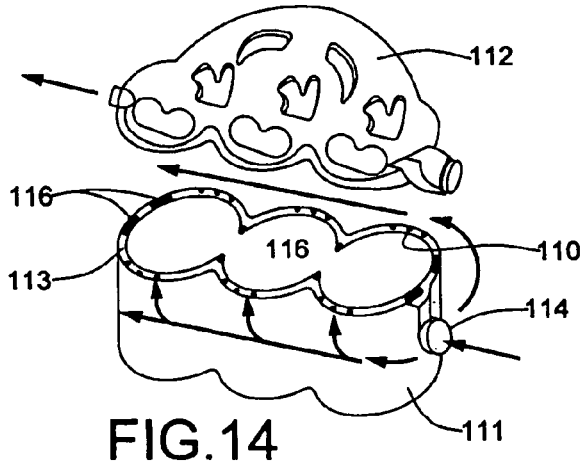
FIG.14 PRIOR ART

FIGS. 11–13 illustrate an alternative embodiment to the present invention that may be desirable for manufacturing reasons. In some instances it may be difficult to install the insert, which is illustrated in FIGS. 1–7 and described hereinbefore, into the water jacket 30. In such cases, manufacturing the insert in two pieces, as illustrated in FIG. 11, may be desirable. It is noted that the insert illustrated in FIGS. 11–13 shares many aspects of the insert illustrated in FIGS. 1–7 and, for that reason, identical reference numbers have been used, as appropriate.

The insert 136 includes a first insert member 136*a* and a second insert member 136*b*. The first insert member 136*a* includes the first support member 44, the first arcuate members 38*a*, 38*b*, and the second and fourth support members 46*b*, 46*a*. Similarly, the second insert member 136*b* includes the third arcuate members 42*a*, 42*b* and the third and fifth support members 48*b*, 48*a*. The second arcuate members 40*a*, 40*b* are not provided by the insert 136. Accordingly, the insert 136 according to the second embodiment is installed in the water jacket 30 by inserting the first insert member 136*a* into the first end of the water jacket, and by inserting the second insert member 136*b* into the opposite or second end of the water jacket.

With reference to FIGS. 12–13, wherein flow through the water jacket 30 with the insert 136 is illustrated, it has been found that the insert 136 provides many of the same advantages as the first embodiment of the present invention. For example, when engine speed is low, the coolant flows primarily in the upper portion 30*a* of the water jacket. Although there tends to be some mixing of coolant due to the lack of isolation between the upper and lower portions 30*a*, 30*b* of the water jacket at the middle portion of the engine block, the fluid tends to continue moving in the same direction as it flows across the second support member 46*b* toward the fourth support member 48*b*, so this mixing is somewhat minimized at low speeds. At higher engine speeds, in which the coolant is moving faster in the upper portion 30*a* of the water jacket, this mixing is more pronounced, but even in this case the coolant flow remains stratified to a certain extent, and mixing tends to be primarily due to the previously mentioned pressure differentials created by increased coolant flow velocity.

The present invention described to this point is also numerous modifications and improvements. For example, and as shown in phantom in FIGS. 6 and 12, a pressure valve 51 may be inserted in one or more of the notches or passageways between the upper and lower water jacket portions 30*a*, 30*b*. With such an arrangement, the valve(s) 51 would open above a pre-defined pressure differential, which is correlated to a predetermined engine speed, and thereby provides even further engine-speed dependent control over coolant flow between the water jacket portions.

Figure 8:
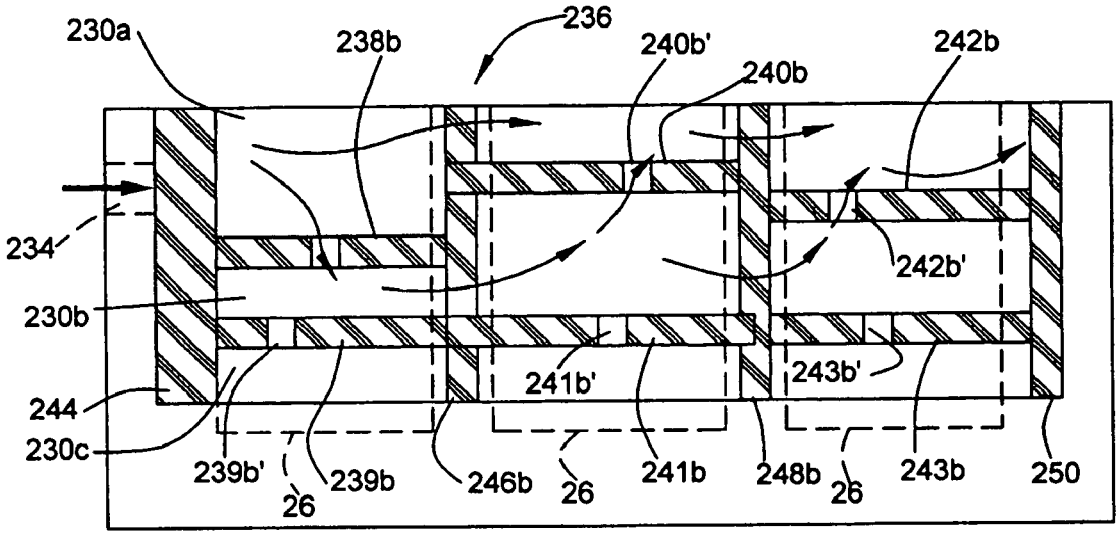
FIG. 8 is a cross-sectional view through the insert according to an alternative embodiment of the present invention.

With reference to FIG. 8, a cross-sectional view through the exhaust-side of a further embodiment of the insert 236 of the present invention is provided. The insert according to the further embodiment includes a series of upright supports 244, 246*b*, 248*b*, 250, and a series of upper arcuate members 238*b*, 240*b*, 242*b* and lower arcuate members 239*b*, 241*b*, 243*b*. The upper arcuate members 238*b*, 240*b*, 242*b* are substantially identical to the arcuate members described hereinbefore with respect to the first embodiment of the insert shown in FIGS. 1–7. The lower arcuate members 239*b*, 241*b*, 243*b* are also substantially identical to the upper arcuate members 238*b*, 240*b*, 242*b*, but are spaced vertically therefrom and cooperate with the upper arcuate members so as to separate the water jacket 30 into an upper portion 230*a*, an intermediate portion 230*b*, and a lower portion 230*c*. Each of the arcuate members include extensions or ear members, as described hereinbefore, so as to fill the wedge-shaped gap between the cylinders and so as to essentially fill the space between the outer surface of the cylinders 26 and the inner surface of the cylinder block 20.

In order to provide desired engine-speed dependent communication of coolant between the water jacket portions 230*a*, 230*b*, 230*c*, each of the arcuate members includes a hole or notch, as described hereinbefore. More specifically, the upper arcuate members 238*b*, 240*b*, 242*b* define a notch 238*b*', 240*b*', 242*b*', respectively, and the lower arcuate members 239*b*, 241*b*, 243*b* define a notch 239*b*', 241*b*', 243*b*', respectively. Naturally, the number and size of the notches will be adjusted to adjust the coolant flow through the water jacket so as to provide the desired cooling properties at the axially spaced portions of the cylinder walls.

As in the first embodiment, the support members 244, 246*b*, 248*b*, 250 serve as structural supports for the upper and lower arcuate members, as spacers or positioning aids that insure proper vertical positioning of the insert 236 within the water jacket 30, and as flow directors to encourage coolant flow toward conjoined portions 28 of the cylinder walls 26. In this regard it is noted that the present embodiment includes an additional support 250 that is positioned at the end opposite the coolant inlet 234, which provides additional support to the insert. It is further noted that although the intake-side of the insert 236 is not illustrated, it will preferably be substantially identical to the exhaust side, with necessary changes to accommodate communication of coolant outlet flow being made.

The embodiment illustrated in FIG. 8 permits further axial stratification of coolant flow and, therefore, variable cooling of the cylinder walls 26. By properly tuning the location and size of the openings or notches in the arcuate members, the present invention permits further control over engine-speed dependent cooling of the cylinder walls.

More specifically, below a first predetermined engine speed coolant will primarily flow in the upper portion 230*a* of the water jacket. As engine speed exceeds the first predetermined engine speed, the pressure differential is great enough to create appreciable flow through the upper arcuate member notches 238*b*', 240*b*', 242*b*' and into the intermediate water jacket portion 230*b*.

Between the first predetermined engine speed and a second predetermined engine speed, coolant flow will be primarily in the upper portion 230*a*, and secondarily in the intermediate portion 230*b*, with little flow in the lower portion 230*c*. However, above the second predetermined engine speed, the pressure and flow within the intermediate portion 230*b* rises to the point that there is a large enough pressure drop between the intermediate portion 230*b* and the lower portion 230*c* to establish coolant flow through the lower arcuate member notches 239*b*', 241*b*', 243*b*'. Accordingly, flow within the water jacket is staged axially, and correlated to engine speed and thereby provides axially tunable coolant efficiency.

Figure 9:
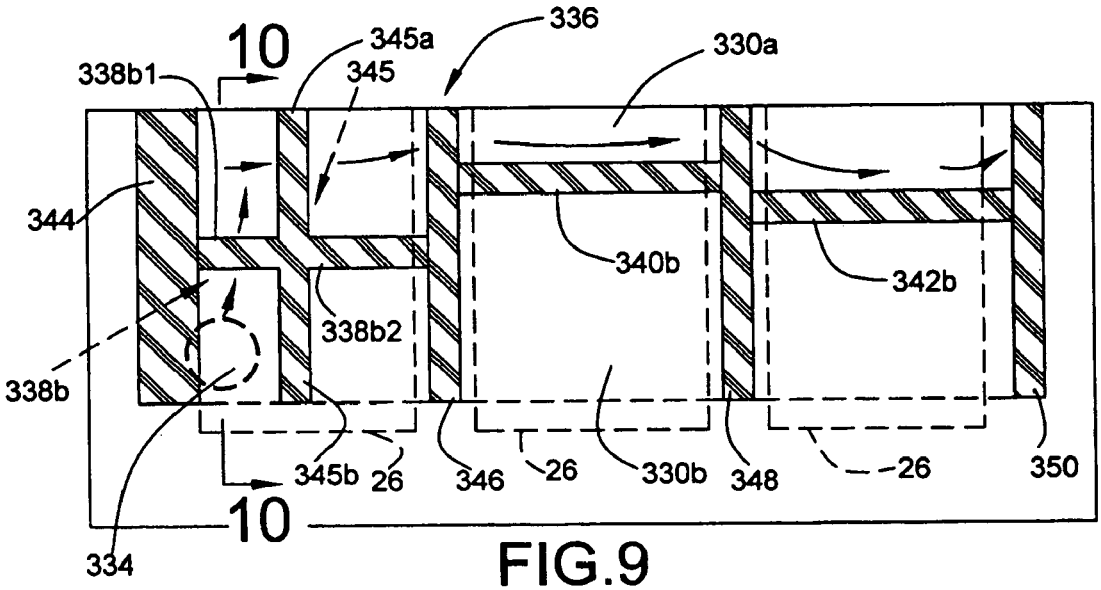
FIG. 9 is a cross-sectional view through a further alternative embodiment of the present invention.
Figure 10:
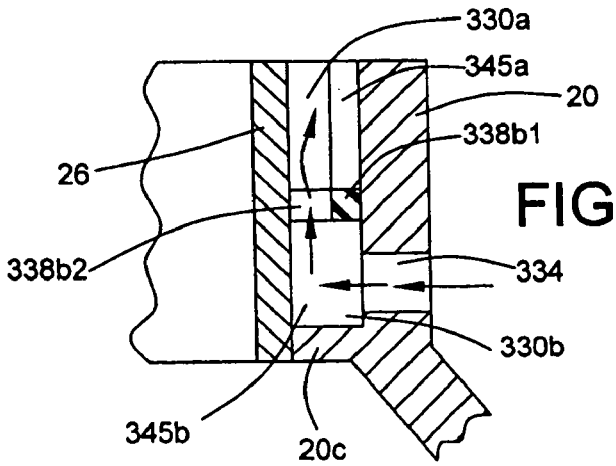
FIG. 10 is a cross-sectional view as seen along line 10—10 in FIG. 9.

FIGS. 9 and 10 illustrate an insert 336 according to a further embodiment of the present invention that is adapted to accommodate a relatively low position for the coolant inlet 334 into the water jacket and wherein the coolant inlet 334 is oriented transverse to the length of the engine block. With the insert 336 of this further embodiment, the advantages of stratified cooling can be realized even in such an engine, and without modification of the engine block design.

With reference to FIG. 9, wherein the exhaust-side of the insert 335 is shown, the inlet 334 is shown to include a series of arcuate members 338*b*, 340*b*, 342*b*, and a series of support members 344, 346, 348, 350. A first arcuate member 338*b* is separated into two segments 338*b*1, 338*b*2, and is bisected by one of the support members 345, which is defined herein as having an upper portion 345*a* and a lower portion 345*b*. The lower portion 345*b* has a width dimension selected so as to extend across or fill the water jacket, whereas the upper portion 345*a* has a relatively reduced width dimension. Similarly, the first segment 338*b*1 of the first arcuate member 338*b* has a reduced width dimension so as to extend only part-way across the water jacket, whereas the second segment 338*b*2 of the first arcuate member 338*b*, like the remaining arcuate members 340*b*, 342*b*, has a width dimension selected so as to extend across the water jacket. Although the arcuate portions 338*b*, 340*b*, 342*b* are shown without notches or openings being formed therein, it is contemplated that such notches would be provided, where appropriate, to permit engine-speed dependent communication of coolant between the water jacket upper and lower portions 330*a*, 330*b*, as described hereinbefore. The remaining portions of the insert 336 are generally as described hereinbefore with regard to the preceding embodiments.

With reference to FIGS. 9–10, coolant enters the water jacket lower portion 330*b* via the inlet 334. Due to the fact that the lower portion 345*b* of the support member 345 seals the water jacket, the incoming coolant is made to flow upwardly over the first segment 338*b*1 of the first arcuate member 338*b* and into the water jacket upper portion 330*a*. The coolant flows past the upper portion 345*a* of the support member 345, and primarily flows in the water jacket upper portion 330*a* due to the fact that the upper portion is isolated from the lower portion 330*b* (with the exception of the holes or notches, if any) by the second segment 338*b*2 of the first arcuate member 338 and the remaining arcuate members 340*b*, 342*b*. Accordingly, even though coolant is introduced into the water jacket in a relatively low position, the insert 336 is able to redirect the coolant into the upper portion and thereafter take advantage of the enhanced stratified axial cooling of the present invention.

It is recognized that the insert of the present invention is capable of numerous modifications to adapt it for insertion into engine blocks currently being manufactured or hereinafter later developed, and that the dimensions, configurations, shapes, etc., of the insert described and illustrated herein are only provided to show and describe the currently most preferred embodiments of the present invention, and are not meant to be limiting in any way. Rather, with knowledge of the present invention, it is recognized that one skilled in the art is capable of making various modifications to the insert to accommodate engine-specific cooling and coolant flow characteristics, and it is submitted that such modifications or customization of the insert will fall within the scope of the claims appended hereto.

The insert is preferably made of an elastomeric material such as rubber, a plastic, or a composite material that can easily fit to the cylinder wall and the block wall surfaces. For example, the insert may be formed from a metal wire core that is over-molded or insert molded with a thermoplastic material having sufficient elasticity and heat resistance. In this regard it is noted that the insert must be able to accommodate the thermal expansion of the cylinder walls without crimping, and, therefore, the elastic deformation of the insert must prevent interference to cylinder wall deformation when the cylinder head is clamped on the block and when the cylinder walls are under mechanical or thermal stress in an operating engine.

Moreover, and as noted hereinbefore, the location and size of the insert openings will affect flow between the axially offset water jacket portions and will be selected so that desired temperature affects on the cylinder surfaces are realized. For instance, if reducing combustion chamber temperature is the most important issue, smaller openings and/or smaller pressure drop are used to ensure good cooling in the upper portion of cylinders. If oil temperature control is more important, the specifications of the design are chosen so that larger openings and/or large pressure drop can be realized. Accordingly, the present invention is not restricted to the particular size, shape, number, or arrangement of notches (flow passages) described and illustrated herein.

What is claimed is:

1. An engine subassembly, comprising:

an engine block having a plurality of cylinders formed therein, said engine block and cylinders cooperating to define a water jacket that surrounds an outer surface of said cylinders, wherein adjacent cylinders are engaged with one another so as to define conjoined cylinder wall portions; and, an insert disposed within said water jacket and comprising a plurality of arcuate members and a plurality of support members, wherein each of said arcuate members is received within said water jacket and at least partially surround one of said plurality of cylinders, and wherein said insert serves to separate said water jacket into at least a first portion and a second portion so as to provide different cooling characteristics to first portions of said cylinders corresponding to said first water jacket portion as compared to second portions of said cylinders corresponding to said second water jacket portion.

2. The subassembly according to claim 1, wherein said first water jacket portion is an upper portion and said second water jacket portion is a lower portion.

3. The subassembly according to claim 2, wherein said engine block has an exhaust-side and an intake-side, and wherein said insert forces incoming coolant to flow first within said upper portion of said water jacket along said exhaust-side of said engine block.

4. The subassembly according to claim 1, wherein said insert separates incoming coolant flow entering said water jacket at an exhaust-side of said engine block from outgoing coolant flow exiting said water jacket at an intake-side of said engine block.

5. The subassembly according to claim 3, wherein said arcuate members define fluid passageways through which coolant may flow between said upper and lower water jacket portions.

6. The subassembly according to claim 5, wherein flow of coolant through said fluid passageways is dependent upon a speed of said engine such that, below a predetermined engine speed coolant flows primarily in said upper water jacket portion and, as the speed of the engine increases above said predetermined engine speed, an increasing amount of coolant flows through said fluid passageways between said upper and lower water jacket portions.

7. The subassembly according to claim 1, wherein said arcuate portions extend across a width of said water jacket so as to substantially seal against said outer surface of said cylinders and an inner surface of said engine block.

8. The subassembly according to claim 7, wherein at least some of said support members are disposed within said water jacket at a location corresponding to, but spaced from, said conjoined cylinder wall portions.

9. The subassembly according to claim 8, wherein said support members have a length that is substantially equal to a height of said water jacket.

10. The subassembly according to claim 9, wherein said first portion is an upper portion and said second portion is a lower portion.

11. The subassembly according to claim 10, wherein said engine block has an exhaust-side and an intake-side, and wherein said insert forces incoming coolant to flow first within said upper portion of said water jacket along said exhaust-side of said engine block.

12. The subassembly according to claim 9, wherein said insert separates incoming coolant flow entering said water jacket at an exhaust-side of said engine block from outgoing coolant flow exiting said water jacket at an intake-side of said engine block.

13. The subassembly according to claim 11, wherein said arcuate members define fluid passageways through which coolant may flow between said upper and lower water jacket portions.

14. The subassembly according to claim 13, wherein flow of coolant through said fluid passageways is dependent upon a speed of said engine such that, below a predetermined engine speed coolant flows primarily in said upper water jacket portion and, as the engine speed increases above said predetermined engine speed, an increasing amount of coolant flows through said fluid passageways between said upper and lower water jacket portions.

15. The subassembly according to claim 1, wherein said insert is integrally formed as a unitary structure.

16. The subassembly according to claim 1, wherein said insert comprises multiple pieces that are spaced from one another within said water jacket.

17. An insert for placement into an engine water jacket so as to separate said water jacket into at least two axially spaced apart portions, comprising:

a plurality of arcuate members, each of said arcuate members being received within the water jacket and extending around at least a portion of a cylinder; and, a plurality of support members, said support members being received within said water jacket and serving to vertically orient and support said plurality of arcuate members;

wherein at least some of said arcuate members define at least a portion of a fluid passageway that permits fluid communication between said at least two axially spaced apart water jacket portions.

18. The insert according to claim 17, wherein said arcuate members have a width dimension that is substantially equal to a width dimension of said water jacket.

19. The insert according to claim 17, wherein at least one of said support members has a width dimension that is substantially equal to a width dimension of said water jacket, and others of said plurality of support members have a width dimension that is substantially less than the width dimension of said water jacket.

20. The insert according to claim 17, wherein at least one of the support members is disposed between two adjacent arcuate members.

21. The insert according to claim 17, wherein the insert is integrally formed as a unitary structure.

22. The insert according to claim 21, wherein the insert is at least partially formed from an elastomeric material.

23. The insert according to claim 17, wherein the insert comprises at least two portions that are placed in the water jacket at spaced-apart locations.

24. A method for cooling a siamese-type internal combustion engine, said engine having an engine block comprising a plurality of cylinders and a cylinder head disposed over said engine block, a water jacket being defined between an outer surface of said plurality of cylinders and an inner surface of said engine block, said water jacket receiving an insert that serves to axially separate said water jacket into an upper portion and a lower portion, said insert also serving to isolate coolant flow entering said water jacket from coolant flow exiting said water jacket, comprising the steps of:

introducing coolant into said water jacket via an inlet formed in said engine block at a first end of said engine block;

directing incoming coolant into the upper water jacket portion and along an exhaust-side of said engine block toward a second end of said engine block;

directing from said second end of said engine block back toward said first end of said engine block;

introducing coolant into said cylinder head at said engine block first end;

conducting coolant through said cylinder head to an outlet formed at said engine block second end.

25. The method according to claim 24, wherein a relative amount of coolant flow in said water jacket lower portion is dependent upon an operating speed of said engine.

26. The method according to claim 25, wherein, below a first predetermined engine speed, coolant flows primarily in said water jacket upper portion and as the engine speed increases above said first predetermined engine speed, an increasing amount of coolant is communicated from said upper water jacket portion to said lower water jacket portion so as to cause further coolant flow in said lower water jacket portion.

27. An engine subassembly, comprising:

an engine block having three of cylinders formed therein, said engine block and cylinders cooperating to define a water jacket that surrounds an outer surface of said cylinders, wherein adjacent cylinders are engaged with one another so as to define conjoined cylinder wall portions; and, an insert disposed within said water jacket and comprising a plurality of arcuate members and a plurality of support members, wherein each of said arcuate members at least partially surround one of said plurality of cylinders, and wherein said insert serves to separate said water jacket into at least a first, upper portion and a second, lower portion; and, wherein coolant flows at a first speed in the water jacket adjacent a first of said three cylinders, said first cylinder being at a first end of said water jacket adjacent an inlet to said water jacket;

coolant flows at a second speed in the water jacket adjacent a second of said three cylinders, said second of said three cylinders being at a second end of said water jacket opposite said first end; and, coolant flows at a third speed in the water jacket adjacent a third of said three cylinders, said third cylinder being intermediate said first and second cylinders; and wherein said third speed is greater than said second speed, and said second speed is greater than said first speed.

* * * * *